US006138316A

United States Patent [19]

Weihrauch

[11] Patent Number: 6,138,316

[45] Date of Patent: Oct. 31, 2000

[54] TOOTHBRUSH WITH REPLACEABLE BRUSH SECTION

[75] Inventor: Georg Weihrauch, Wald-Michelbach, Germany

[73] Assignee: CORONET-Werke GmbH, Wald-Michelbach, Germany

[21] Appl. No.: 09/194,785

[22] PCT Filed: Jun. 19, 1997

[86] PCT No.: PCT/EP97/03207

§ 371 Date: Dec. 3, 1998

§ 102(e) Date: Dec. 3, 1998

[87] PCT Pub. No.: WO97/49314

PCT Pub. Date: Dec. 31, 1997

[30] Foreign Application Priority Data

Jun. 22, 1996 [DE] Germany ..... 196 24 962

[51] Int. Cl.[7] ..... A46B 9/04; A46B 7/04

[52] U.S. Cl. ..... 15/176.4; 15/167.1; 15/176.5

[58] Field of Search ..... 15/167.1, 176.1, 15/176.4, 176.5, 176.6, 194, 202

[56] References Cited

U.S. PATENT DOCUMENTS 1,518,341 12/1924 Mendoza ..... 15/176.4

5,555,590 9/1996 Blum et al. ..... 15/176.5

5,864,915 2/1999 Ra ..... 15/176.4

FOREIGN PATENT DOCUMENTS 24 02 785 7/1975 Germany .

*Primary Examiner*—Robert J. Warden, Sr.

*Assistant Examiner*—Kaj K. Olsen

*Attorney, Agent, or Firm*—Paul Vincent

[57] ABSTRACT

A toothbrush comprises a handle, a head constructed as an at least one-sided open casing, a brush part insertable in its open side and having a support and a bristle facing, as well as locking means in the form of interengaging projections and recesses within the casing and on the support for fixing the brush part, the casing having a cheek supporting the support over its entire circumferential surface and on the head are provided means for the toolless pressing out of the brush part. In order to separate the functions "sealing" and "locking", on its inside the casing cheek and on its periphery the support are constructed as completely smooth-walled sealing surfaces and, outside the sealing surfaces, the locking means have inwardly displaced, resilient detents.

21 Claims, 8 Drawing Sheets

TOOTHBRUSH WITH REPLACEABLE BRUSH SECTION

BACKGROUND OF THE INVENTION

The invention relates to a toothbrush with a handle, a head constructed as a casing open on at least one side, a brush part insertable in said open side and having a support and a bristle facing and with locking means within the casing and on the support for fixing the brush part, the casing having a side plate or cheek supporting the support in the vicinity of its periphery and on the head means for the toolless pressing out of the brush part from the back of the head.

Brushes are known (U.S. Pat. No. 403,350, U.S. Pat. No. 1,148,566, U.S. Pat. No. 1,711,621, U.S. Pat. No. 2,326, 632), in which the brush part having the bristle facing is subsequently inserted in the actual brush body. This frequently takes place for manufacturing reasons and particularly if it is impossible to directly connect the bristle bundles to the brush body, e.g. by thermal processes, such as welding, moulding in, etc. Constructions are also known in which the brush part is detached from the brush body and can be replaced by another brush part (GB 1932/1910). The known constructions are not or are only inadequately suitable for tooth-brushes.

Toothbrushes are required much more frequently than other types of brushes. The reason is the frequent use necessary for correct oral hygiene (up to three times daily) and the rapid wear resulting from this. In addition, even in the case of relatively limited wear which would be acceptable with other brushes, a toothbrush has to be replaced, so as to always ensure an optimum effectiveness.

Due to the high toothbrush consumption, approximately 150 million per annum in Germany, there is an increasing problem of disposal and protecting resources, because the material fraction rendered unusable due to wear is extremely small compared with the total material and the total material to be disposed of, even in the case of a 100% recycling, cannot be processed to the same product, because the recycled material no longer fulfils the high quality requirements, which are vital e.g. for the bristle material of a toothbrush. Even if the known brushes with a replaceable brush part would fundamentally make it possible to only replace the brush part after wear, this problem has not hitherto been in the foreground and also in the case of standard brushes, such as cleaning brushes, body brushes, cosmetic brushes, etc. it is relatively unimportant, because the use period is much longer and the material ratio of unusable and still usable material is not in the same disproportion as with toothbrushes.

Finally, in connection with toothbrushes account must be taken of the special feature that they must be correctly usable by humans of all age classes and all education levels, so that the replacement of the brush part must be possible in a very simple manner and with limited force expenditure, whilst at the same time adequately securely joining the parts.

At present there are essentially two systems on the market. In the case of so-called replacement head brushes (EP 0 199 849 B1, DE 94 20 405 U1) the entire head with the bristles is detachably fixed to the handle. The locking fixing means are located on the handle substantially transversely to its longitudinal axis and on a shoulder of the head and are brought into engagement by the assembly of the head and handle in the longitudinal axial direction. Conversely the two parts can be detached by pulling apart in the longitudinal axial direction. These replacement head brushes are satisfactory from the use and hygienic standpoints.

However, the plastics fraction of the head, which becomes waste when the bristles become worn, is still considerable. The further disadvantage arises that the fixing means are located in the transition area between head and handle, i.e. in an area where the greatest bending forces act during use. However, it is precisely in this area that the toothbrush is weakened by the constructional measures for the fixing means. This is particularly serious because, for use reasons, between the handle and the head it is desirable to have a slender and optionally resilient neck, which cannot be implemented with such replacement head brushes. Therefore replacement head brushes have already been proposed, in which the head is locked with the slender neck on the thicker handle. Thus, although the use advantage is substantially maintained, this is achieved at the cost of a larger amount of plastics waste. In addition, the risk also arises with all replacement head brushes, that in the case of incorrect locking or a failure of the locking system during use, serious injury can occur in the oral cavity.

With other known systems, to which belongs the toothbrush according to the preamble of claim 1, the bristles are fixed to a support in the form of a thin plate and said brush part is replaceably locked in the frame or casing-like head (DE 30 38 895, 37 24 640). The support is provided on its circumferential surface with ledge-like catches and the casing has corresponding channel-like depressions. On its back the support also has a pin, which engages in a hole in the bottom of the casing and forms on the back of the head an exposed pressure surface. The support is locked in the head and can be ejected by pressure on the pin. The plastics fraction to be replaced in the case of bristle wear is reduced to a minimum and the replaceable brush parts can be inexpensively manufactured due to the small amount of material used. However, hygienic and constructional problems arise as compared with replacement head brushes. In the gap necessarily present between the support and the casing cheek, which only dries inadequately, there is a deposition of dirt and accumulation of bacteria. This applies to a greater or lesser extent for the entire gap between head and support.

Thus, on its bristle side, the support is provided with an elastic, circumferential border (DE 37 24 640 C2), whose back sealingly engages against the front face of the casing cheek. This presupposes corresponding tensile forces drawing the support into the casing and consequently correspondingly high locking forces. In turn these make more difficult the insertion and ejection of the brush part. As locking takes place by self-closure, the locking means must be of a correspondingly large-volume nature, which requires considerable wall thicknesses on the head. Even more complicated is a construction (DE 296 00 398 U1), in which on all the sealing faces between the support and casing are provided elastic flat seals, which by a correspondingly high pretension simultaneously retain the brush part. The pretension must be completely absorbed by the casing cheek, which necessarily widens after a short time and a reliable hold of the brush part is no longer ensured.

Other proposals (DE 91 09 625 U1, DE 44 34 617 A1), which provide locking ledges in portionwise manner on the support circumference, lead to a corresponding reduction of the sealing of the gap, because the locking ledges and recesses are located in the sealing surfaces and very narrow tolerances must be respected, in order on the one hand to ensure a snug engagement of the sealing surfaces and on the other a reliable locking. It is scarcely possible to achieve such tolerances with injection moulded parts and the inexpensive plastics required for the head and handle. In addition, the casing cheek is constantly under elastic pretension due to the locking forces. Since plastics are not creep-resistant under tension (cold flow), there is a very rapid decrease to the tensional force of the casing cheek, so that the gap between cheek and support enlarges and the infiltration of dirt and bacteria is aided. As plastic fatigue and the resulting increase in the tolerances can scarcely be noticed by the user, he may only notice the failure of the locking means when cleaning the teeth. If the brush part is detached during use, it can once again lead to injury to the oral cavity and gingiva.

A very stable and durable connection of the brush part and head is brought in a known toothbrush (DE 41 04 314 A1) in that on the back of the support are shaped two mutually V-shaped ledges, which pass over the entire support length. They engage in a slot on the head opening outwards in V-shaped manner and which also passes over the entire length in its longitudinal axis. During insertion the ledges must be deformed inwards and towards one another to such an extent that they can pass through the narrowest cross-section of the V-shaped slot and then expand in said slot. Thus, the elastically deformed parts of the locking connection are located on the replacement part, where material fatigue is less important. The deformation forces on the ledges required for producing and detaching the locking connection are so high that the brush part can only be pressed or levered out with the aid of specially adapted tools. The need for such special tools not only leads to correspondingly high system costs for the consumer, but is prejudicial to a practical acceptance of the system by the market. This also applies because it is not possible to fulfil a requirement for avoiding injury, namely a smooth shape of the brush back. In addition, this toothbrush is also completely unacceptable for hygienic reasons, because the slot and ledges form several cracks, in which can be deposited dirt, toothpaste residues and bacteria.

The latter disadvantage is somewhat reduced in another known construction (U.S. Pat. No. 4,543,679), in that in place of the ledges an expanding pin is provided, which engages in an outwardly conically widening hole on the casing bottom.

The problem of the invention is to so construct a toothbrush of the aforementioned type, that the special hygienic requirements are fulfilled and the use characteristics improved.

SUMMARY OF THE INVENTION

According to the invention this problem is solved in that the mutually engaging surfaces on the cheek of the casing and on the periphery of the support are constructed as completely smooth-walled sealing surfaces and the locking means have resilient detents inwardly displaced with respect to the sealing surfaces and which are located in a space between the casing bottom and the support back facing it.

An important advantage of the invention is that the functions "sealing" and "locking" are constructionally separated. The smooth periphery on the support and the smooth contact surface of the cheek constitute the prerequisite for a completely satisfactory, sealing engagement with one another of said surfaces. This can be assisted by a slightly conical construction of these surfaces. As a result of the construction of the locking means as resilient detents outside the sealing surfaces the casing cheek is not placed under pretension by locking and retaining forces and consequently cold flow cannot occur there, so that it can fulfil its sealing function for a long time. Cavities, gaps, etc. are avoided to such an extent that, in the desired manner, after use the toothbrush rapidly dries and consequently the accumulation of bacteria is prevented, whilst the deposition or infiltration of toothpaste residues, etc. are avoided. The resilient detents ensure a functionally reliable locking, but still permit an easier replacement.

As the locking means are exclusively located in the interior of the casing between its bottom and the back of the support, the outer contour of the toothbrush in the vicinity of the head can be adapted in optimum manner to the intended correct use, e.g. rounded, smooth contours are ensured, so that during oral hygiene oral cavity injuries are avoided, whilst the resilient detents are positioned in an area where their dimensioning is not constricted by other constructional circumstances. They can therefore be so designed that their operational reliability is maintained over a long period. The entire, thin-walled casing cheek is kept free from tension. The positioning of the locking means on the one hand and the pressure surface for detachment on the other ensure that the bristle part is not detached in an untimely manner, because the pressure acting on the bristles during use cannot lead to a release of the locking system and instead for this purpose it is necessary to have a planned, but limited pressure on the back of the head. The easy replaceability of the brush part encourages the use of this system by the user, particularly as the possibility exists of using brush parts with bristles having different hardness characteristics and positioning.

In a preferred construction the resilient detents are shaped in inwardly projecting manner on the casing bottom and cooperate with depressions on the support back.

An advantageous embodiment is characterized in that on the casing bottom forming the back of the brush head there is a through opening, whose wall is at least partly inwardly lengthened towards the resilient detents and that the support has a pin engaging in said through opening whose front face forms an exposed pressure surface for pressing out the brush part or cooperates with a pressure surface on the casing.

In this embodiment the through opening with its sleeve-like wall fulfils several functions. It can firstly guide the pin on the support and secondly at least part of its wall serves to construct the resilient detents, i.e. for positioning and fixing the support. Finally, the through opening provides the possibility of constructing the pressure surface on the back of the head. It is either formed directly by the pin passing through the through opening, namely by its exposed front face, or it is constructed as a casing part closing said through opening on the back of the head and the pressure applied to the pressure surface acts on the pin via the casing.

If the pin is guided on the wall of the through opening, it is provided on its circumference with the depressions in which spring from the outside the detents on the casing.

If the exposed front face of the pin forms the pressure surface, it advantageously slightly projects over the contour of the casing on the back of the head, which indicates its function and the pressure for releasing the locking system can be applied without difficulty.

Apart from the use advantages, the aforementioned embodiment has the advantage that the toothbrush only comprises two components, namely the handle with the head forming the casing and the brush part with the support and bristles. Therefore the toothbrush can be easily and inexpensively manufactured.

An embodiment which is somewhat more complicated from the manufacturing standpoint, but offers the same use advantages, is characterized in that the pin is placed in the through opening spaced from its wall and the support has depressions externally engaging over the resilient detents.

Preferably the through opening on the back of the head is closed by a pressure plate forming the pressure surface and which internally engages on the front face of the pin.

This construction has the advantage that the toothbrush head is completely closed on the back, where there are consequently no sealing problems with all their possible disadvantages.

In this embodiment the pressure plate forming the pressure surface can be made from a rubber-like material, e.g. an elastomer and can be subsequently inserted on the opening rim of the through opening and fixed e.g. by locking on the wall of the opening or moulded onto the opening in an in-mould process. The pressure plate is at least elastically deformable to such an extent that when pressure is exerted on the pressure plate the distance necessary for the release of the support is covered. Thus, the pressure is applied by the pressure plate on the pin, so that the support is displaced in the pressure direction and the detents are freed.

Instead of this the pressure plate can be in one piece with the head and can either be connected by a correspondingly thin wall thickness of the head in this area in resilient manner to the remaining casing, or this takes place by means of a flexible wall portion.

If the pressure plate is a one-piece, but resilient part of the head, the detents can be shaped laterally of the pressure plate on the casing bottom and can be expanded from the locking position fixing the support between them by pressure on the pressure plate and accompanied by the freeing of the support.

The spring characteristic of the detents can be obtained with virtually any random plastics material by a certain length of the detents, whereas the casing can be dimensionally stable. Spring characteristics can also be achieved by thinner wall portions on the back of the head, so as to permit the movement with a limited travel of the pressure plate forming part of the casing. In addition, such flexible wall portions can be constructed in the area of the start of the detents on the casing, so that pressure on the pressure plate gives rise to their displacement, as well as an expansion of the detents, so that the support comes free from the locking system and can drop out downwards.

Externally the cheeks engage entirely or partially over the support, a complete overengagement with a flush connection of the outer faces of the support and cheek being advantageous in order to avoid corners, recesses, etc.

Instead of this the support can also engage on the front face of the cheek and be flush with its outside. This creates an additional sealing surface. This construction also has no recesses or steps, which would aid dirt deposition.

In another embodiment, the support has a circumferential border on the side opposite to the bristle facing and with which it externally engages over the cheek.

This embodiment has the advantage that the support forms a closed surface not only in the area of the bristle facing, but also on the sides of the head.

It is mainly these areas which come into contact with the gingiva when the toothbrush is in use, so that through the smooth surface in this area an injury risk is prevented. In addition, the areas close to the bristle facing, due to the toothpaste applied there, have a particular dirt deposition tendency, whilst also allowing the accumulation of bacteria. Due to the smooth, gap and recess-free construction of the support and its border engaging over the cheeks such problems are avoided.

Both the aforementioned embodiments have the advantage that for a given contour of the head, it is possible to provide a maximum number of bristles on the support.

The inventive construction of the casing also offers the possibility of the support being made from an elastomer and being sealed against the cheek, which can be assisted by sealing lips. The inventive construction of the casing ensures that the cheeks clamp and compress in frame-like manner the elastomer support. Additional increased frictional forces occur in the area of the sealing faces, which reliably avoids gaps. The ends of the bristles located in the support are elastically supported.

Finally, the pressure surface can be optically differentiated from the remaining casing by the surface design, so as in this way to indicate the function of the pressure surface to the user. This optical differentiation can take place by a corresponding profiling, different material, colouring, etc.

At least in the area of the cheek, the casing can externally have a soft elastic covering in order to protect the mucosa. This can additionally cover the front face of the cheek and with its inner edge sealingly engage on the circumferential surface of the support.

Since in the case of the inventive construction the locking means are no longer located on the casing cheek, but instead only fulfil guidance and sealing functions, they can be thinner than in the known constructions. Conversely the support surface and consequently the number of bristles or bundles can be increased or enlarged.

The invention is described in greater detail hereinafter relative to nonlimitative embodiments and with respect to the attached drawings, wherein show:

Figure 1:
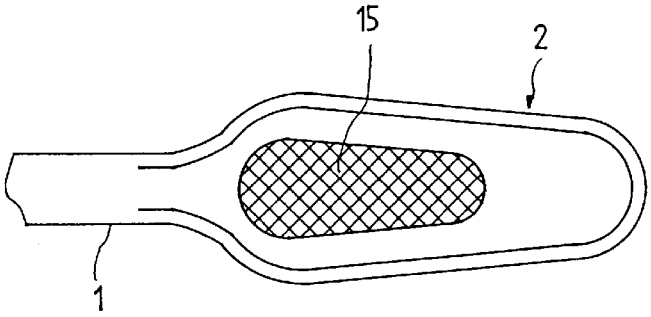
FIG. 1 A partial representation of a toothbrush in a plan view of the back.
Figure 2:
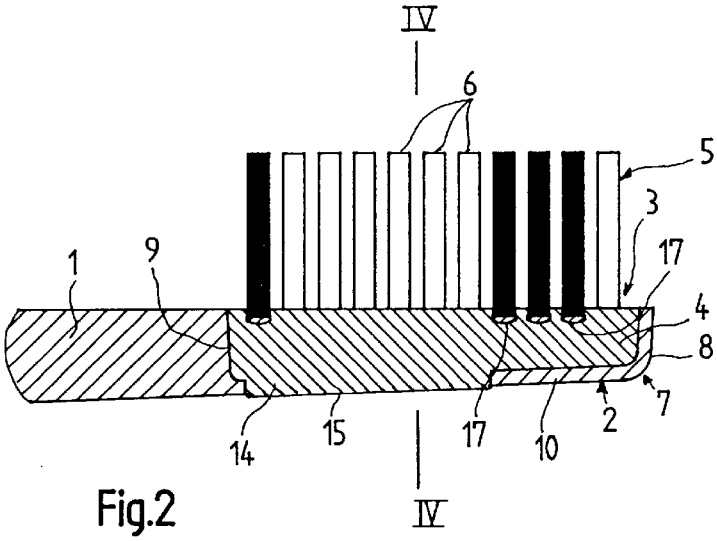
FIG. 2 A section II—II of FIG. 3.
Figure 3:
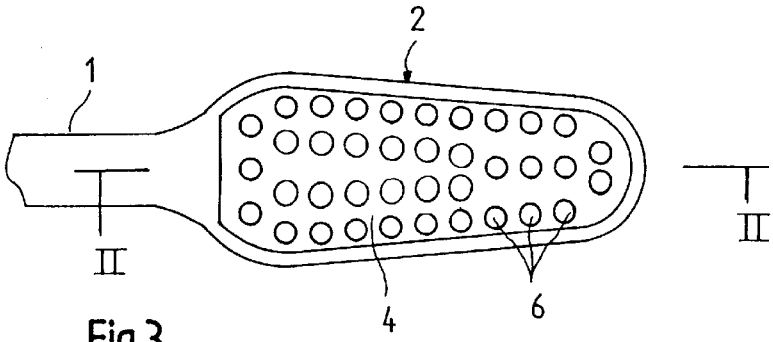
FIG. 3 A plan view of the bristle facing.

The toothbrush shown in FIGS. 1 to 3 comprises a broken away represented elongated handle 1, a head 2 and a replaceable brush part 3, which has a support 4 with the bristle facing 5 of individual bristle bundles 6. The head 2 of the toothbrush is constructed as a casing 7 in which is replaceably inserted the brush part 3 with its support 4.

DESCRIPTION OF THE PREFERRED EMBODIMENTS

Figure 4:
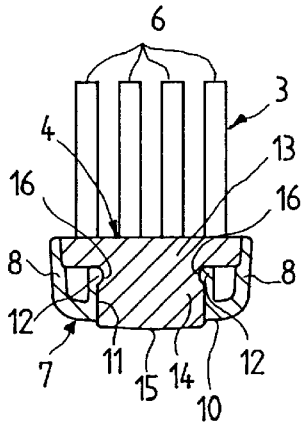
FIG. 4 A section IV—IV of FIG. 2.

In all the embodiments the casing 7 has as a lateral boundary a circumferential side plate or cheek 8, which is closed by a wall 9 towards the handle 1 (FIGS. 2 and 4). With the wall 9 the circumferential cheek 8 forms a type of dimensionally rigid frame, which together with the back 10 forms a downwardly open cavity for receiving the support 4.

In the embodiment according to FIGS. 1 to 4 the casing also has a through opening 11, whose wall is at least partially formed by resilient detents 12 projecting into the cavity. The planar support 4 on the side of the bristle facing 5 comprises a plate-like part 13, whose contour corresponds to the contour formed on the inside of the cheek 8 and the wall 9, as well as a pin 14, which passes through the through opening 11 and is additionally guided therein. The pin 14 has an exposed front face projecting slightly over the back 10 of the casing 7 and which forms a pressure surface 15. As shown in FIG. 1, this pressure surface can be optically differentiated, optionally also surface-profiled.

With the resilient detents 12 in the area of the through opening 11 are associated correspondingly shaped locking recesses 16 on the support 4, which in the represented embodiment are located on the circumference of the pin 14 in the area of the transition to the plate-like part 13 and inwardly displaced with respect thereto.

From the use position shown in FIGS. 2 and 4 the brush part 3 can be easily replaced by a new brush part, in that with the finger a pressure acting in the direction of the bristle facing is exerted on the pressure surface 15 under which the resilient detents 12 retreat outwards, so that the brush part 3 drops downwards.

The bristles 6 of the brush part 3 can be fixed in numerous different ways to the support 4, e.g. in preshaped holes, by anchoring means or adhesive, but can also be welded to the support or, provided with thickened portions 17, moulded into the same.

Figure 5:
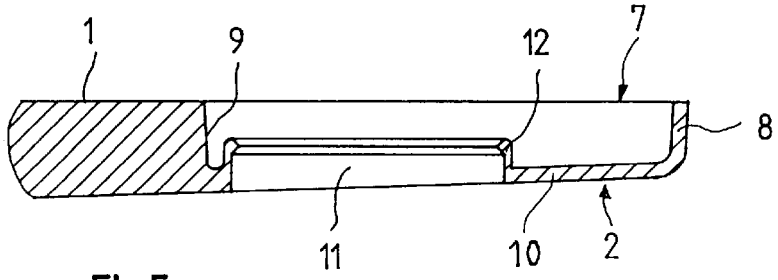
FIG. 5 A longitudinal section through the toothbrush head in another embodiment without the brush part.
Figure 6:
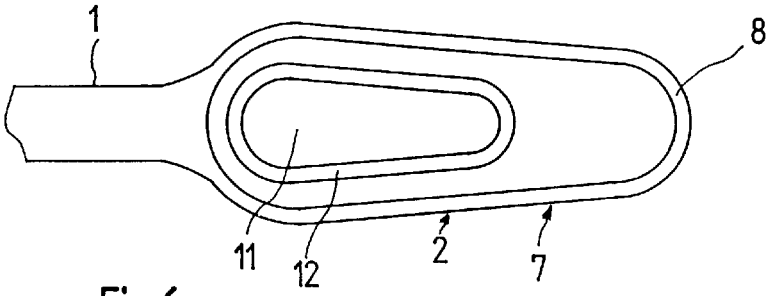
FIG. 6 A bottom view of the head.
Figure 7:
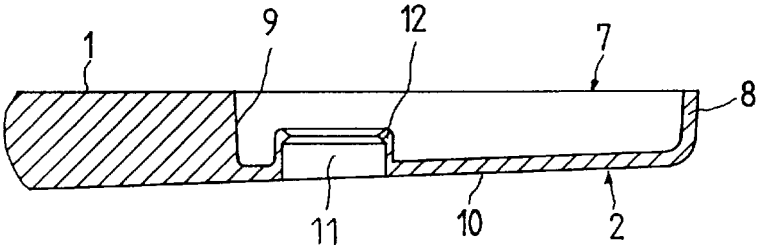
FIG. 7 A section corresponding to FIG. 5 of another embodiment.
Figure 8:
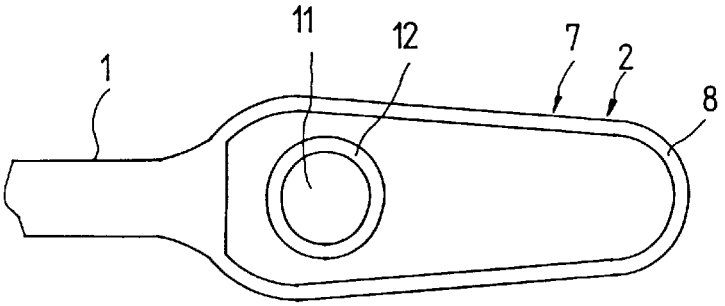
FIG. 8 A bottom view of the brush head according to FIG. 7.

In the embodiment of FIGS. 5 and 6 the through opening 11 has an asymmetrical oval shape and its wall in the cavity of the casing 7 is lengthened towards the resilient detents 12, which form a circumferential ring. The embodiment of FIGS. 7 and 8 differs from that of FIGS. 5 and 6 only in that the through opening 11 and resilient detent 12 are circular.

Figure 9:
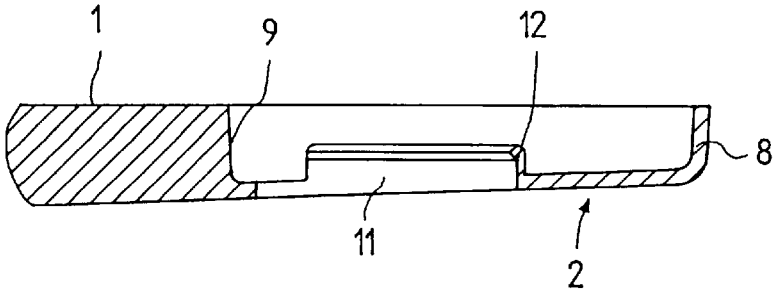
FIG. 9 A longitudinal section through the brush head in another embodiment.
Figure 10:
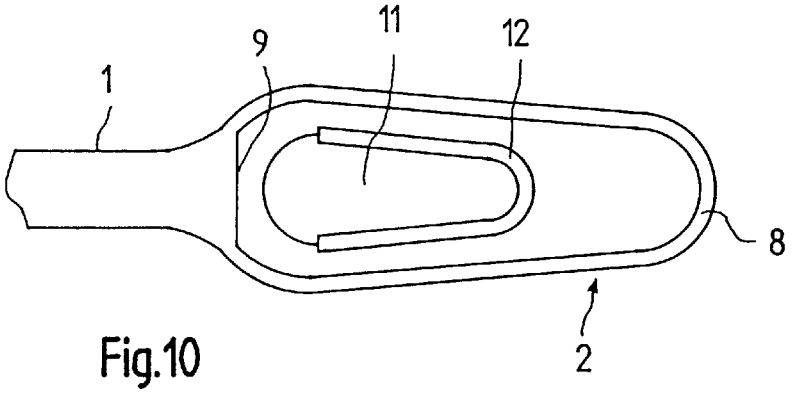
FIG. 10 A bottom view of the head according to FIG. 9.
Figure 11:
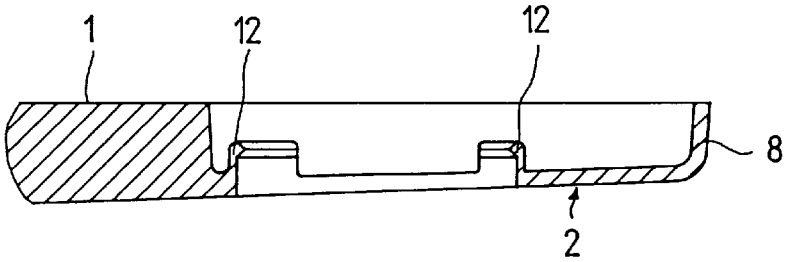
FIG. 11 A longitudinal section through the head in another construction.
Figure 12:
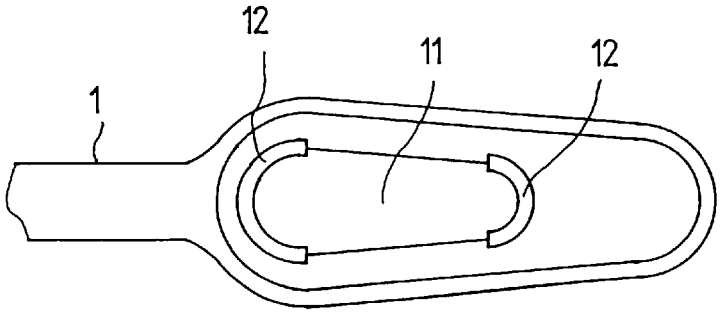
FIG. 12 A bottom view of the head according to FIG. 11.
Figure 13:
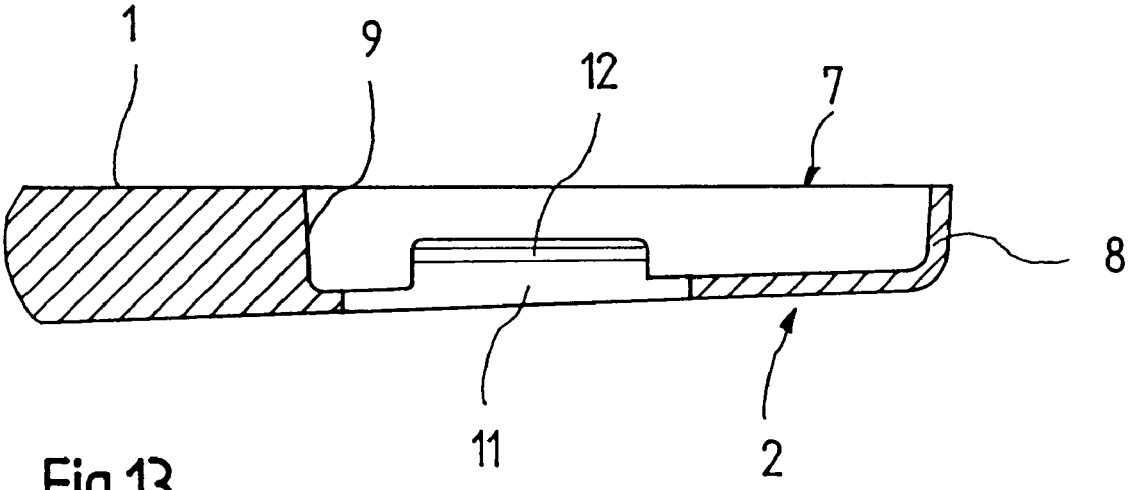
FIG. 13 A longitudinal section through the brush head in a modified construction.
Figure 14:
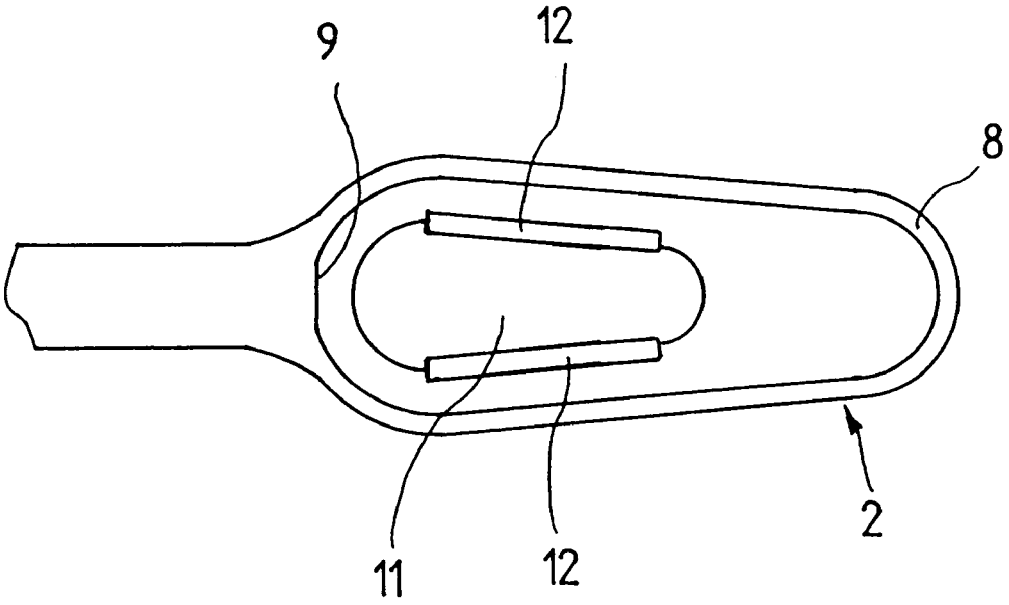
FIG. 14 A bottom view of the head according to FIG. 13.
Figure 15:
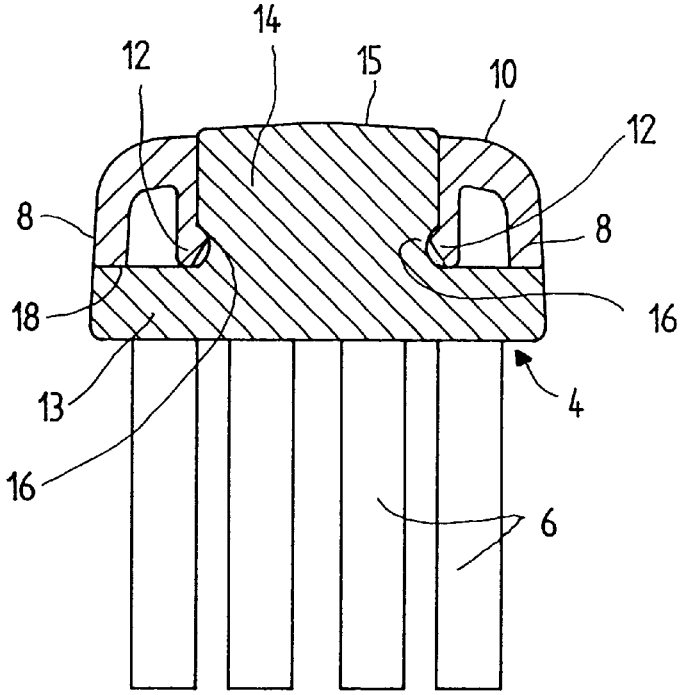
FIG. 15 a cross-section of the brush head according to FIG. 4 with a first construction of the casing and the brush part support.

In the embodiments according to FIGS. 9 to 14 the wall of the through opening 11 only partially projects into the cavity for forming the resilient detent 12. Thus, FIGS. 9 and 10 show a detent 12 having a U-shape, whereas in the embodiment according to FIGS. 11 and 12 the through opening 11 on the facing narrow sides forms two resilient detents 12 with an arcuate shape and in FIGS. 13 and 14 the wall of the through opening on the longitudinal sides is lengthened to the opposite detents 12.

FIGS. 15 to 22 show different constructions of the casing, support and locking means. In the embodiment of FIG. 15 the support 4 once again has a plate-like part 13 and a shoulder 14, as well as the head-forming casing, much as in the embodiment of FIG. 4. Differing from the latter embodiment, the plate-like part 13 of the support 4 forms the lower termination of the head and the cheek 8 with its front face 18 forms an abutment for the top of the plate-like part 13 of the support 4. Otherwise the support 4 is terminated in circumferentially flush manner with the outside of the cheek 8.

Figure 16:
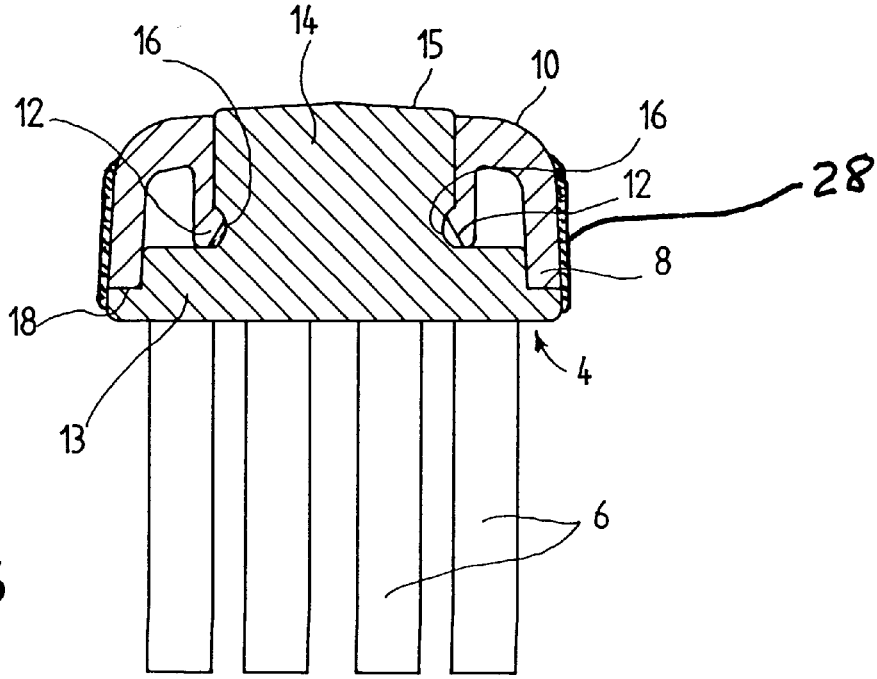
FIG. 16 a cross-section of the brush head according to FIG. 4 with a second construction of the casing and the brush part support.

In the embodiment of FIG. 16 the plate-like part 13 of the support 4 is inwardly offset in step-like manner on its top and engages with the step on the front face 18 of the cheek 8. The plate-like part 13 is guided with the drawn in part on the inside of the cheek 8. In this embodiment an elastomer covering 28 is injected onto the outside of the cheek and protects the mucosa. The covering 28 can project over the front face of the cheek 8 and sealingly engages on the circumference of the plate-like part 13.

Figure 17:
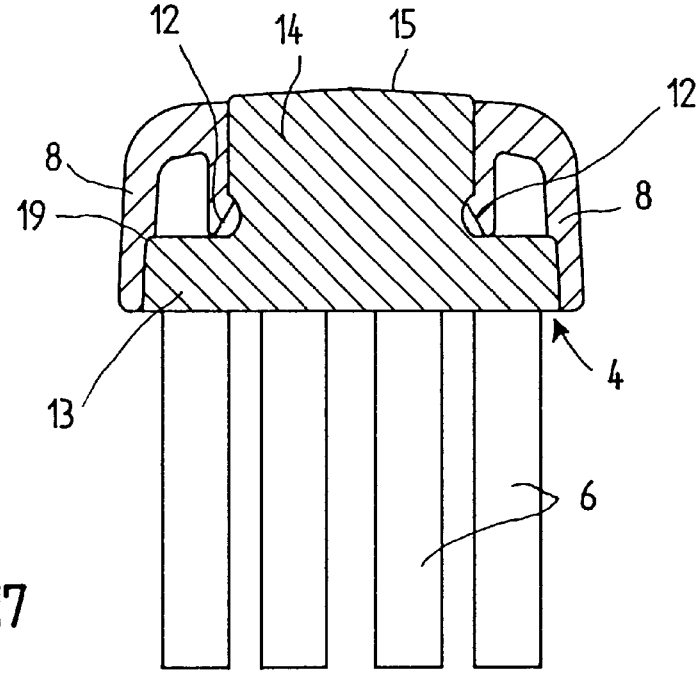
FIG. 17 a cross-section of the brush head according to FIG. 4 with a third construction of the casing and the brush part support.

Unlike in FIG. 16, FIG. 17 shows a support 4 with a plate-like part 13, which is once again mounted and guided on a step 19 on the inside of the head cheek 8.

Figure 18:
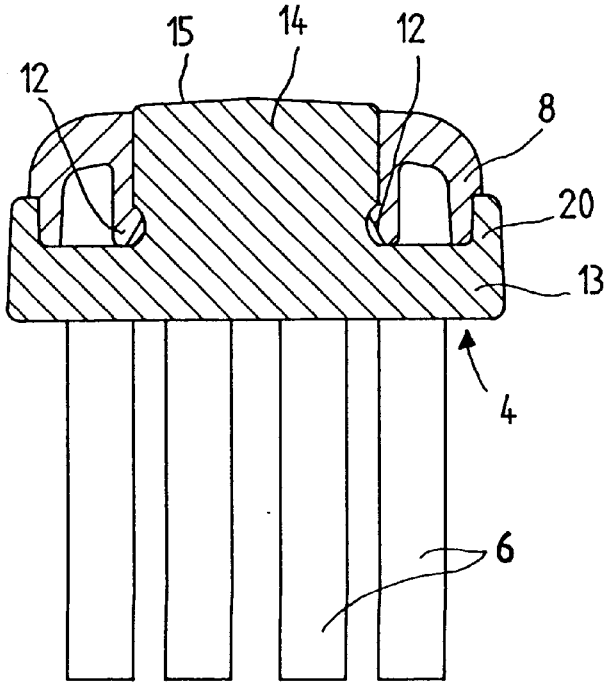
FIG. 18 a cross-section of the brush head according to FIG. 4 with a fourth construction of the casing and the brush part support.
Figure 19:
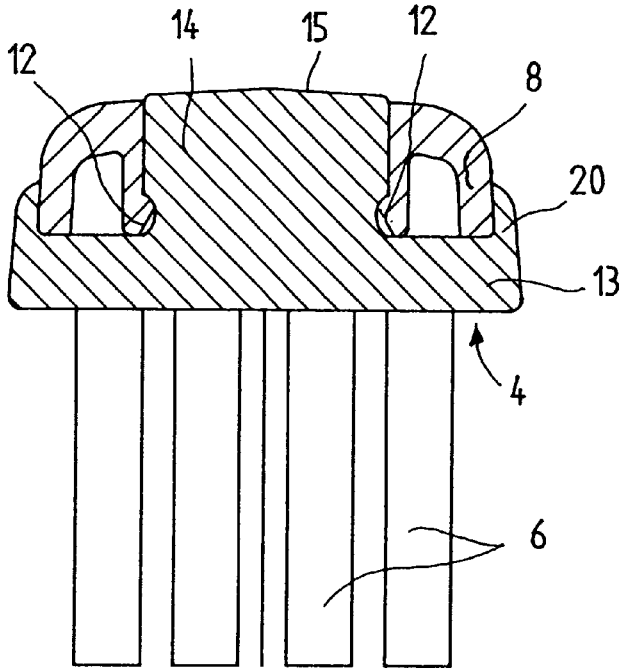
FIG. 19 a cross-section of the brush head according to FIG. 4 with a fifth construction of the casing and the brush part support.

In the embodiment according to FIG. 18 the support 14 has on its plate-like part 13 an upwardly drawn border 20 in which engages on the inside with a corresponding step the cheek 8. Another construction is shown in FIG. 19, where the cheek 8, without an external step, engages behind the raised edge 20 of the support 4.

Figure 20:
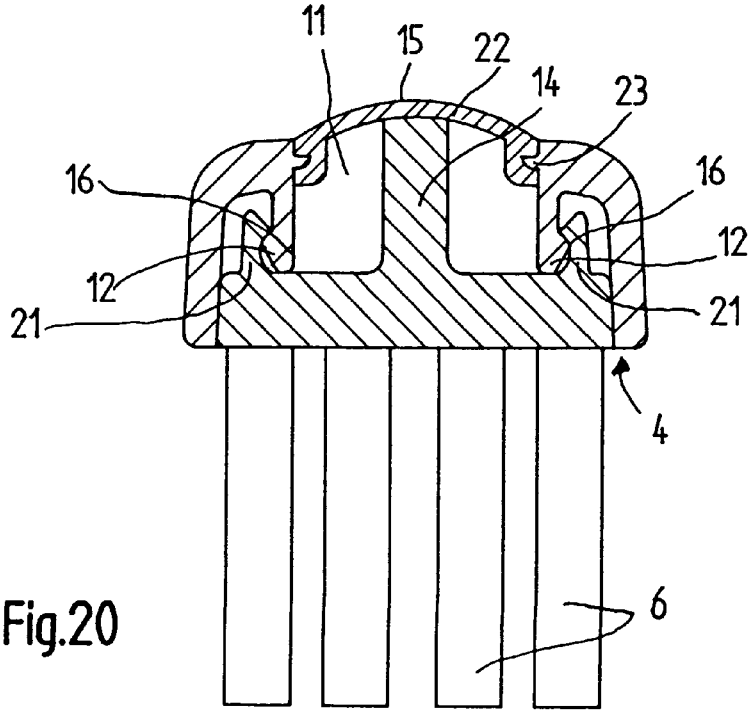
FIG. 20 a cross-section of the brush head according to FIG. 4 with a sixth construction of the casing and the brush part support.
Figure 21:
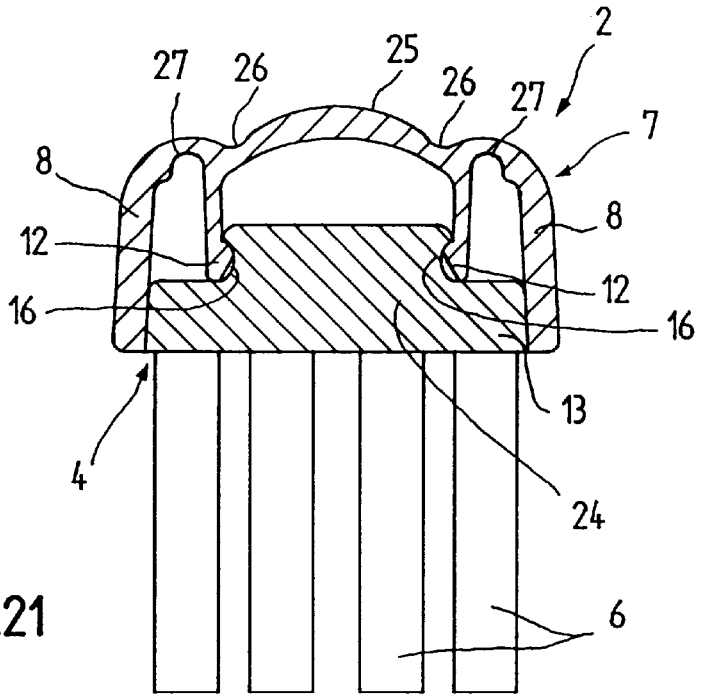
FIG. 21 a cross-section of the brush head according to FIG. 4 with a seventh construction of the casing and the brush part support.
Figure 22:
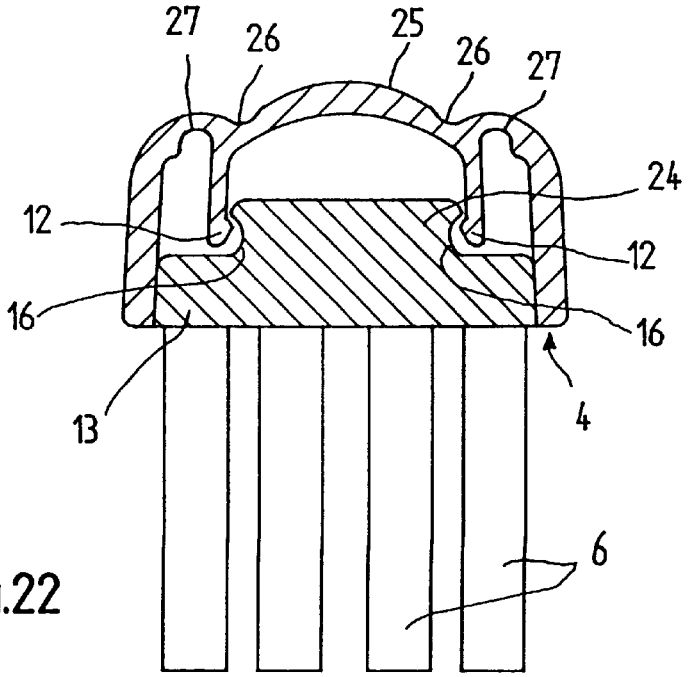
FIG. 22 a cross-section of the brush head according to FIG. 4 with a eighth construction of the casing and the brush part support.

In the embodiment according to FIG. 20 the resilient detents 12 point outwards and the support 4 is provided with upwardly projecting studs 21, which form the locking recesses 16, over which externally engage the detents 12. The pin 14 passes through the through opening 11 with a greater spacing from the wall in this embodiment. The through opening 11 is closed at the top by a pressure plate 22 forming the pressure surface 13 and which at 23 is locked or moulded on the wall of the through opening 11. The pressure plate 22 has a rubber-like construction. The underside of the pressure plate 22 engages on the front face of the pin 14. If pressure is exerted on the pressure surface 22 the pin 14 is moved downwards. The rigid studs 21 on the support move the resilient detents 12 inwards, which frees the support 4 with the bristle bundles 6.

In the embodiment according to FIG. 21 the support 4 once again has a platelike part 13 and a shorter pin 24 than in the preceding embodiments and which on its circumference forms the locking recesses 16 for the resilient detents 12. In the centre the casing 7 has a pressure plate 25, which is connected to the casing by means of thin-walled, resilient wall portions 26. Immediately following onto the wall portions 26 are shaped resilient detents, which are once again connected by means of resilient wall portions 27 to the cheeks 8 of the casing 7. In the case of pressure on the pressure plate 25 the detents 12 are expanded outwards (FIG. 22) as a result of the elastic wall portions 26 and 27, freeing the support 4 with the bristle bundles 6, so that it drops downwards.

As can be gathered from the drawings, in all the embodiments the engaging inside of the cheek 8 and the circumferential surface of the support 13 are smooth and slightly inwardly conically tapered, whereas the locking means 12, 16 are inwardly displaced over the same.

What is claimed is:

1. A tooth brush having a handle and a head, the toothbrush comprising:

a casing disposed at the head, said casing having a cavity with an opening on at least one side of said casing, said cavity having a center, said casing having a cheek with a smooth-walled sealing section; a brush member for insertion into said cavity through said opening, said brush member having a support and a bristle facing, said support having a smooth-walled sealing section cooperating with said cheek sealing section to seal said cavity; and locking means for holding said brush member within said cavity for tool-less pressing of said brush member out of said cavity from a backside of the head, said locking means having a casing detent disposed on said casing and a support detent disposed on said support, wherein said casing detent is a resilient member displaced from said casing sealing section and said support sealing section in a direction towards said center, said resilient member comprising a nose projecting towards said center to engage a depression in said support detent.

2. The toothbrush of claim 1, wherein a bottom of said casing has a bottom-wall defining a through opening, said wall inwardly lengthened towards said resilient member, wherein said support comprises a pin engaging said through opening, an end face of said pin forming a pressure surface for pressing out said brush member.

3. The toothbrush of claim 2, wherein said end face is exposed and projects slightly beyond a contour of said casing bottom at a back of the head.

4. The toothbrush according to claim 2, wherein said pressure surface has a design visually differentiated with respect to the head.

5. The toothbrush of claim 1, wherein a bottom of said casing has a wall defining a through opening, said wall inwardly lengthened towards said resilient member, wherein said support comprises a pin engaging said through opening, an end face of said pin forming a pressure surface for pressing out said brush member.

6. The toothbrush of claim 5, wherein said pin is guided by said wall and wherein said depression is formed on an outer girth of said pin.

7. The toothbrush of claim 1, wherein said cheek engages said support at an outer side of said support.

8. The toothbrush of claim 1, wherein a back of said support engages an end of said cheek and is flush with an outer side of said cheek.

9. The toothbrush of claim 1, wherein a back of said support comprises a circumferential edge externally engaging over said cheek.

10. The toothbrush of claim 1, wherein said support is made from an elastomer for sealing against said cheek.

11. The toothbrush according to claim 1, wherein said casing comprises an external soft elastic cove ring to protect mucosa.

12. The toothbrush of claim 11, wherein said covering covers a front face of said cheek to sealingly engage with said support.

13. A toothbrush having a handle and a head, the toothbrush comprising:

a casing disposed at the head, said casing having a cavity with an opening in at least one side of said casing, said cavity having a center, said casing having a cheek with a smooth-walled sealing section;

a brush member for insertion into said cavity through said opening, said brush member having a support and a bristle facing, said support having a smooth-walled sealing section cooperating with said cheek sealing section to seal said cavity; and locking means for holding said brush member within said cavity for tool-less pressing of said brush member out of said cavity from a backside of the head, said locking means having a casing detent disposed on said casing and a support detent disposed on said support, wherein said support detent is a resilient member displaced from said casing sealing section and said support sealing section in a direction towards said center, said resilient member having a depression facing said center to engage in a nose of said casing detent.

14. A toothbrush having a handle and a head, the toothbrush comprising:

a casing disposed at the head, said casing having a cavity with an opening in at least one side of said casing, said cavity having a center, said casing having a cheek with a smooth-walled sealing section;

a brush member for insertion into said cavity through said opening, said brush member having a support and a bristle facing, said support having a smooth-walled sealing section cooperating with said cheek sealing section to seal said cavity; and locking means for holding said brush member within said cavity for tool-less pressing of said brush member out of said cavity from a backside of the head, said locking means having a casing decent disposed on said casing and a support detent disposed on said support, wherein one of said casing detent and said support detent is a resilient member displaced from said casing sealing section and said support sealing section in a direction towards said center, wherein said casing has a bottom wall defining a through opening, said wall inwardly lengthened towards said resilient member, wherein said support comprises a pin engaging said through opening, an end face of said pin forming a pressure surface for pressing out said brush member, and wherein said through opening is closed at the back of the head by a pressure plate forming a pressure surface, said pressure plate having an inside surface contacting said end face of said pin.

15. The toothbrush of claim 14, wherein said pressure plate comprises a flexible wall portion to connect said pressure plate to said casing.

16. The toothbrush of claim 14, wherein said pressure plate is resilient.

17. The toothbrush of claim 16, wherein said pressure plate is made from an elastomer.

18. The toothbrush of claim 17, wherein said pressure plate is injection moulded together with the head in an in-mould process.

19. The toothbrush of claim 14, wherein said pressure plate is integral with said casing.

20. The toothbrush of claim 14, wherein said pressure plate is constructed as a separate injection moulding and fixed to the head.

21. The toothbrush of claim 14, wherein said casing detent is said resilient member and is disposed at sides of said pressure plate for expansion out of a locked position fixing said support to free said support, in response to pressure on said pressure plate.

* * * * *